US008413567B2

(12) United States Patent
Luther et al.

(10) Patent No.: US 8,413,567 B2
(45) Date of Patent: Apr. 9, 2013

(54) VEHICLE ARMOR

(75) Inventors: Regis Luther, Naperville, IL (US); Walter John Budd, Rochester, MI (US); Louis Caballero, Saline, MI (US); David M Gerst, Fort Wayne, IN (US); Craig Alan Newman, East Lansing, MI (US); Mike Kochman, Ann Arbor, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 173 days.

(21) Appl. No.: 13/096,583

(22) Filed: Apr. 28, 2011

(65) Prior Publication Data

US 2011/0314999 A1 Dec. 29, 2011

Related U.S. Application Data

(60) Provisional application No. 61/357,665, filed on Jun. 23, 2010.

(51) Int. Cl.
*F41H 7/04* (2006.01)

(52) U.S. Cl.
USPC ..... 89/36.08; 89/901

(58) Field of Classification Search ..... 89/36.01, 89/36.02, 36.08, 901, 929; 296/193.07
See application file for complete search history.

(56) References Cited

U.S. PATENT DOCUMENTS 4,198,454 A * 4/1980 Norton ..... 428/117
4,404,889 A 9/1983 Miguel
4,492,282 A * 1/1985 Appelblatt et al. ..... 180/68.1
4,572,571 A * 2/1986 Malen ..... 296/193.07
5,533,781 A 7/1996 Williams
5,663,520 A * 9/1997 Ladika et al. ..... 296/187.07
6,363,830 B1 * 4/2002 Gonzalez ..... 89/36.01
6,477,934 B1 * 11/2002 Bruhn et al. ..... 296/193.07
6,779,431 B2 * 8/2004 Honlinger ..... 296/193.07
7,069,836 B1 * 7/2006 Palicka et al. ..... 89/36.02
7,114,764 B1 10/2006 Barsoum et al.
7,255,034 B2 * 8/2007 Strassgurtl et al. ..... 296/193.07
7,712,823 B2 * 5/2010 Greuter et al. ..... 296/187.07
7,770,506 B2 * 8/2010 Johnson et al. ..... 89/36.09
7,810,875 B2 * 10/2010 Gerisch ..... 296/193.07
7,854,472 B2 * 12/2010 Gomi ..... 296/193.07
8,096,225 B1 * 1/2012 Johnson et al. ..... 89/36.08
8,151,685 B2 * 4/2012 Joynt ..... 89/36.02
8,220,378 B2 * 7/2012 Gamache et al. ..... 89/36.02
8,246,106 B2 * 8/2012 Boczek et al. ..... 296/187.12
2003/0010189 A1 * 1/2003 Zonak ..... 89/36.08
2007/0084337 A1 * 4/2007 Strassgurtl et al. ..... 89/36.08
2008/0066613 A1 * 3/2008 Mills et al. ..... 89/36.09

(Continued)

*Primary Examiner* — Bret Hayes
*Assistant Examiner* — Joshua Freeman
(74) *Attorney, Agent, or Firm* — Jeffrey P. Calfa; Mark C. Bach

(57) ABSTRACT

The disclosed vehicle armor includes a first layer forming an interior bottom surface of the cabin and comprised of a high-strength metal material, a second layer forming an exterior bottom surface of the cabin and comprised of a high-strength metal material, and, a middle layer sandwiched between the first and second layers and comprised of a polymer material. The underbelly device is configured having a plurality of high areas and low areas creating deflection faces and separation distances between an interior of the cabin and an exterior threat. A second, multi-layer composite structure, forming an interior floor of the cabin, may be incorporated as a fragmentation penetration barrier.

24 Claims, 15 Drawing Sheets

U.S. PATENT DOCUMENTS

2008/0315629 A1* 12/2008 Abe et al. ..... 296/193.07
2009/0102238 A1* 4/2009 Gomi ..... 296/193.07
2009/0293712 A1* 12/2009 Ran et al. ..... 89/36.08
2010/0011948 A1* 1/2010 Johnson et al. ..... 89/36.02
2010/0078966 A1* 4/2010 Onoda et al. ..... 296/193.07
2011/0079134 A1* 4/2011 JacQuemont et al. ..... 89/36.02
2011/0168001 A1* 7/2011 Lee ..... 89/36.02
2011/0197744 A1* 8/2011 Cox ..... 89/36.02
2012/0186424 A1* 7/2012 Tunis et al. ..... 89/36.02
2012/0186428 A1* 7/2012 Peer et al. ..... 89/36.02

* cited by examiner

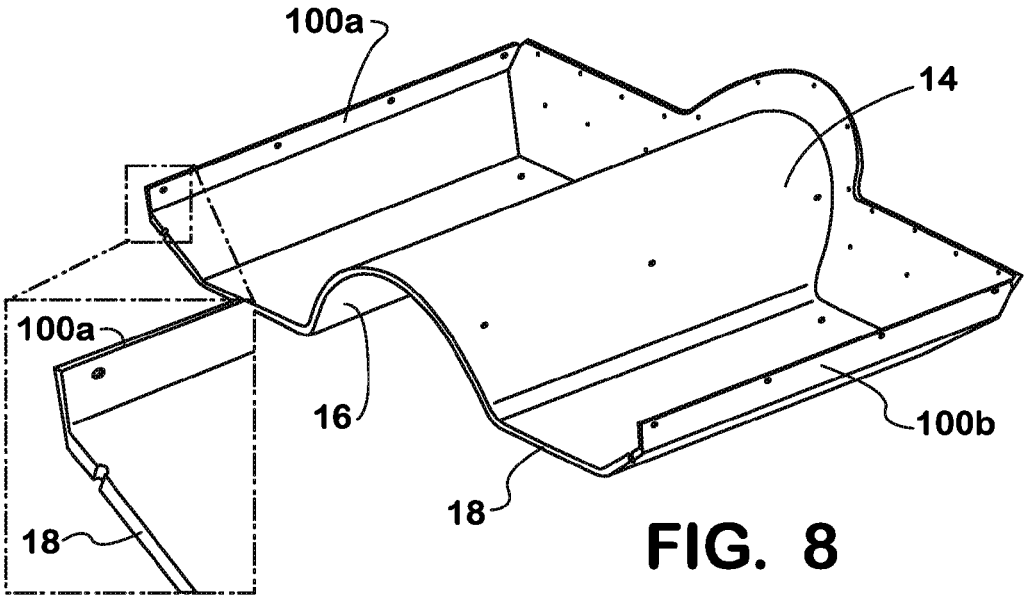
FIG. 8
FIG. 8A
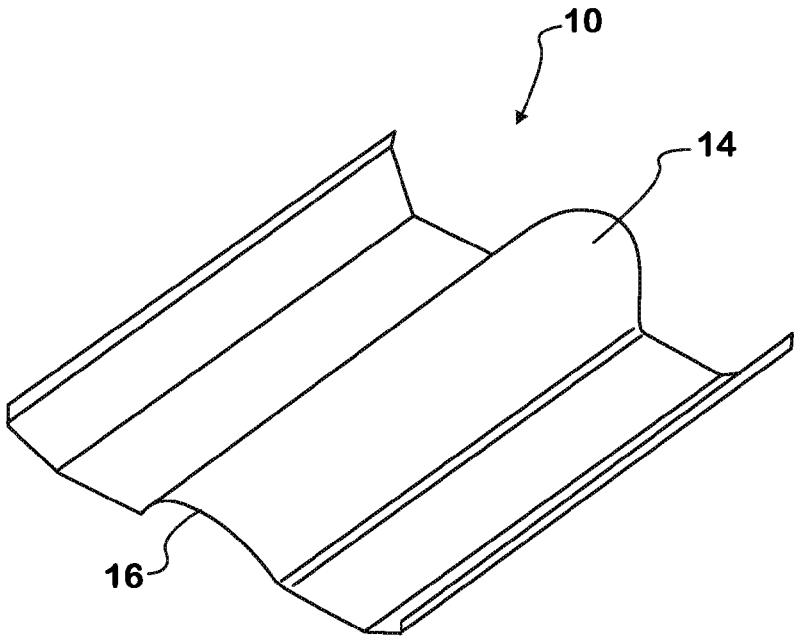
FIG. 9

VEHICLE ARMOR

REFERENCE TO RELATED APPLICATIONS

This application is a conversion of the provisional patent application Ser. No. 61/357,665 filed on Jun. 23, 2010.

TECHNICAL FIELD

The present device relates to a protective armor for critical areas of vehicles, including underbelly armor for military vehicles. More specifically, the device relates to an armored floor construction for a personnel cabin using a combination of layered materials and structural configurations to protect the vehicle occupants from blast energy and fragmentation resulting from an explosive device.

BACKGROUND

Armored vehicles are threatened by improvised explosive devices (IEDs) designed to cause harm to the vehicle and its occupants. IEDs are typically one or more grouped artillery shells redeployed and detonated in an effort to inflict casualties. Harm from these devices typically comes in the form of high pressure blast energy and ballistic fragmentation in the following predominant ways: (1) rapid surface pressure and destructive hull deformation resulting in hull breach and direct occupant exposure to blast pressures and intense heat; (2) high velocity, hull and/or floor accelerations resulting in occupant incapacities; and (3) high velocity fragmentation passing through armor and impacting occupants.

Armor countermeasures typically consist of heavy metal plates placed between the threat and the vehicle in such a way as to resist hull breach and aggressive floor accelerations. These heavy metal plates also work in concert with layers of additional metal, ceramic, composite or plastic materials designed to prevent lethal high velocity artillery shell fragments from entering the vehicle. The heavy metal plates are typically mounted to the underside of the vehicle in a V-shape in an effort to take advantage of shape efficiency and deflection characteristics when presented with incoming pressure and fragmentation. Carrying heavy blast and fragment resistant hulls results in significant performance disadvantage to the vehicle in terms of reduced fuel economy, lost cargo capacity and increased transportation shipping costs.

The present device is an armored floor device, or blast floor, for a personnel cabin, using a combination of layered materials and having certain configurations to increase the distance from an outside threat at the vulnerable bottom centerline position to protect the occupants from blast energy and fragmentation. In addition, the intended device seeks to provide an improved blast and ballistic performance armored hull floor at significantly reduced weights.

SUMMARY

There is disclosed herein an improved system and method for protecting a personnel cabin of a military vehicle which avoids the disadvantages of prior systems while affording additional structural and costs advantages.

Generally speaking, a composite armor for use as an underbelly of a personnel cabin for a vehicle is disclosed, which comprises a first layer forming an interior bottom surface of the cabin and comprised of a high-strength metal material, a second layer forming an exterior bottom surface of the cabin and comprised of a high-strength metal material, and a middle layer sandwiched between the first and second layers and comprised of a polymer material. Alternatively, the middle or core layer comprises a plurality of layers comprised of at least one material selected from the group consisting of a thermoplastic polymer, a fiber reinforced composite or aromatic polyamide.

In various embodiments of the device, the underbelly is configured having a raised ridge along a center central longitudinal line area and lower parallel edges. The underbelly may have any shape, including a curvilinear shape or a saddle shape. The raised ridge includes opposing higher ends and a lower center along the longitudinal area line of the cabin, creating an increased distance at opposing ends of the cabin between the interior space and an exterior threat.

In other embodiments of the device, the device further comprises a second multilayered structure comprising a first layer comprised of a glass fiber reinforced polymer matrix material and a second layer comprised of a metal. The second multilayered structure is positioned above and partially integrated with the underbelly forming an interior floor of the cabin, the interior floor being configured having a raised ridge along a center central longitudinal line area and lower parallel edges complementary to the underbelly.

In yet another embodiment, a blast protection structure forming a floor of a personnel cabin of a vehicle, is disclosed. The structure comprises a first layer forming an interior bottom surface of the floor and comprised of at least one material selected from the group consisting of a high-strength low-alloy steel, a hardened aluminum, or a high carbon steel, a second layer forming an exterior bottom surface of the floor and comprised of at least one material selected from the group consisting of a high-strength low-alloy steel, a hardened aluminum, or a high carbon steel, a middle layer sandwiched between the first and second layers and comprised of at least one material selected from the group consisting of a polypropylene thermoplastic composite or a glass fiber reinforced thermoplastic composite, wherein the floor is configured having a raised ridge along a central longitudinal line area of the cabin and lower parallel sides, the raised ridge further having opposing higher ends and a lower center along the central longitudinal area of the cabin creating a distance at opposing ends of the cabin between the interior space and an exterior threat. The blast protection structure may also include a shield structure on the exterior of the cabin.

In yet another embodiment, a blast protection floor for an occupant cabin of a personnel vehicle, is disclosed. The floor comprises a composite structure configured having a plurality of high areas and low areas creating deflection faces, venting areas, and separation distances between an interior of the cabin and an exterior threat. When an explosive device is encountered and detonated, the deflection faces and venting areas deflect and vent the blast force away from the interior of the cabin and its occupants. In addition, the high and low areas create the separation distance between the explosion and the interior of the cabin, dissipating the force of the explosion prior to it reaching the interior of the cabin. A second composite structure may be added, which serves as an interior floor of the cabin and a fragmentation penetration barrier to the interior of the cabin. The second composite structure has a configuration complementary to that of the floor.

BRIEF DESCRIPTION OF THE DRAWINGS

FIG. 8 is a cross section view of the armored underbelly device showing the lateral edges, with a close-up of the lateral edges in FIG. 8A;

FIG. 9 is a perspective view of a single layered armored underbelly device;

DETAILED DESCRIPTION

Figure 5:
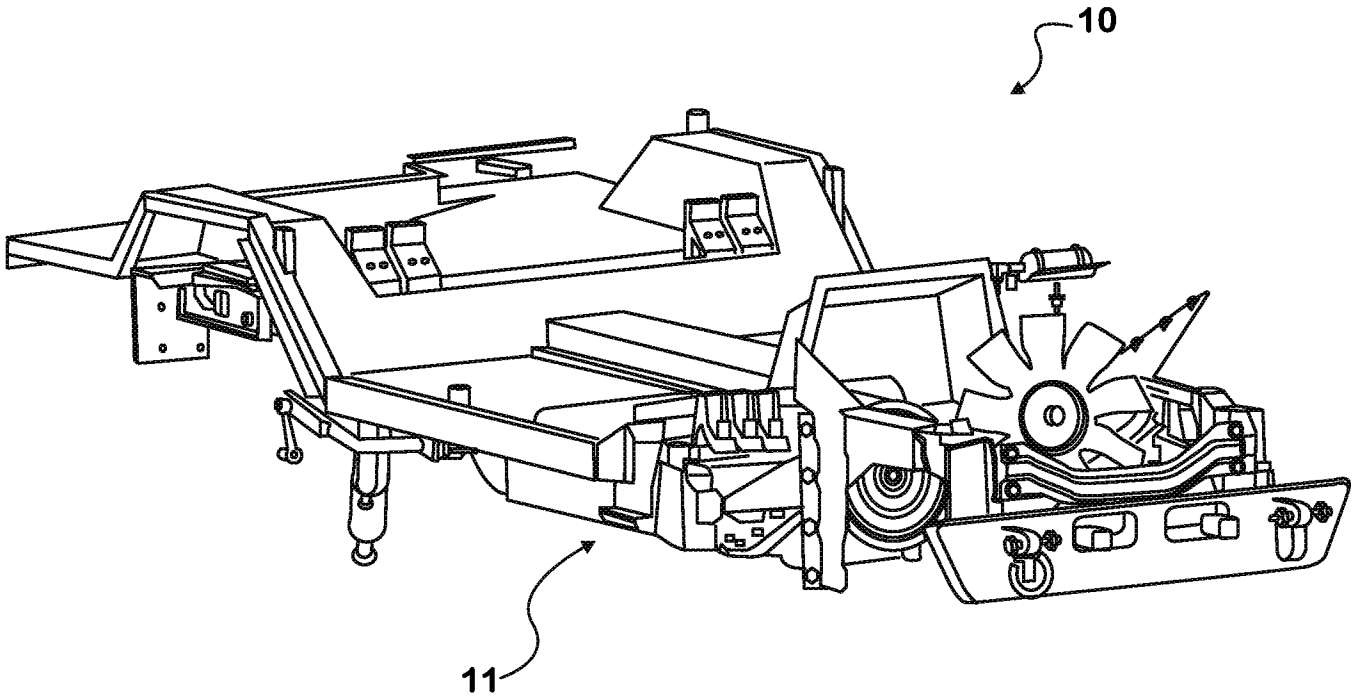
FIG. 5 is a perspective view of a portion of a vehicle having an embodiment of the armored underbelly device.
Figure 6:
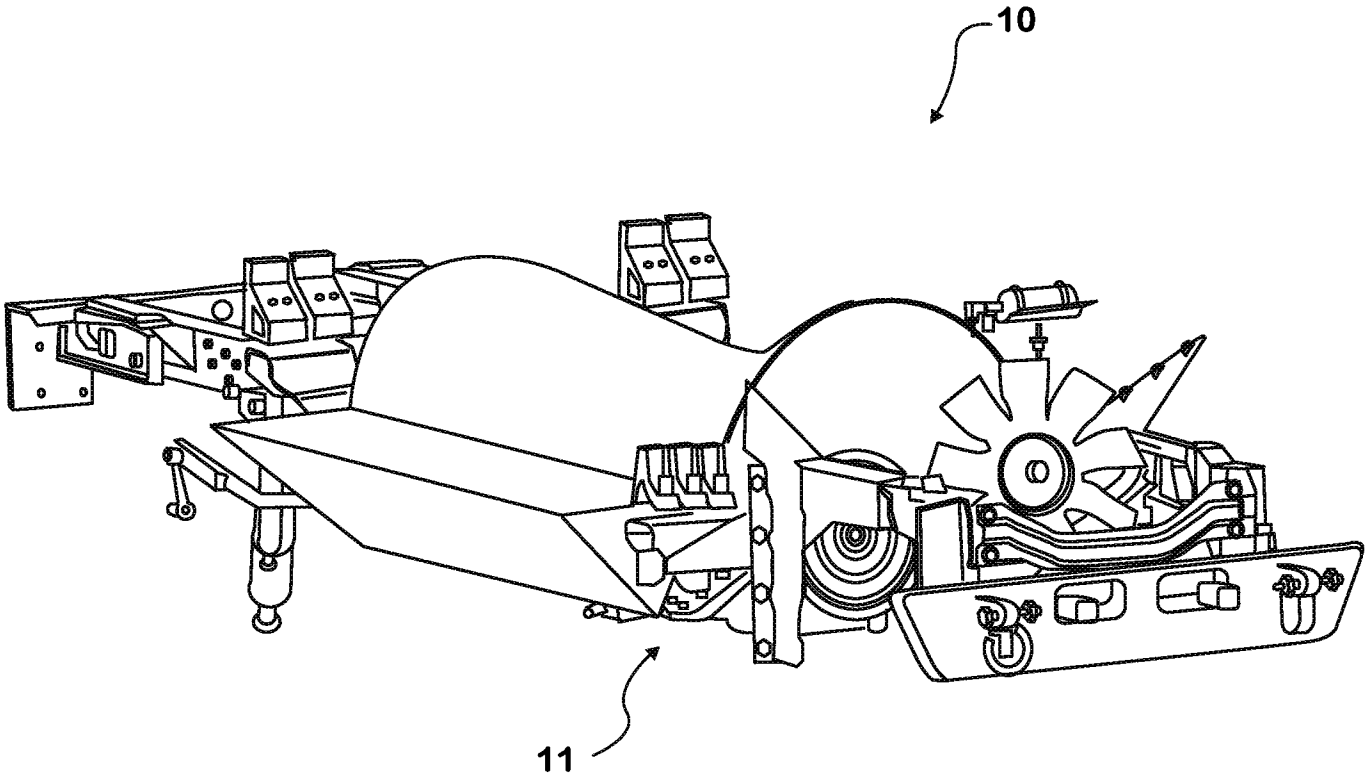
FIG. 6 is a perspective view of a portion of a vehicle having another embodiment of the armored underbelly device.
Figure 7:
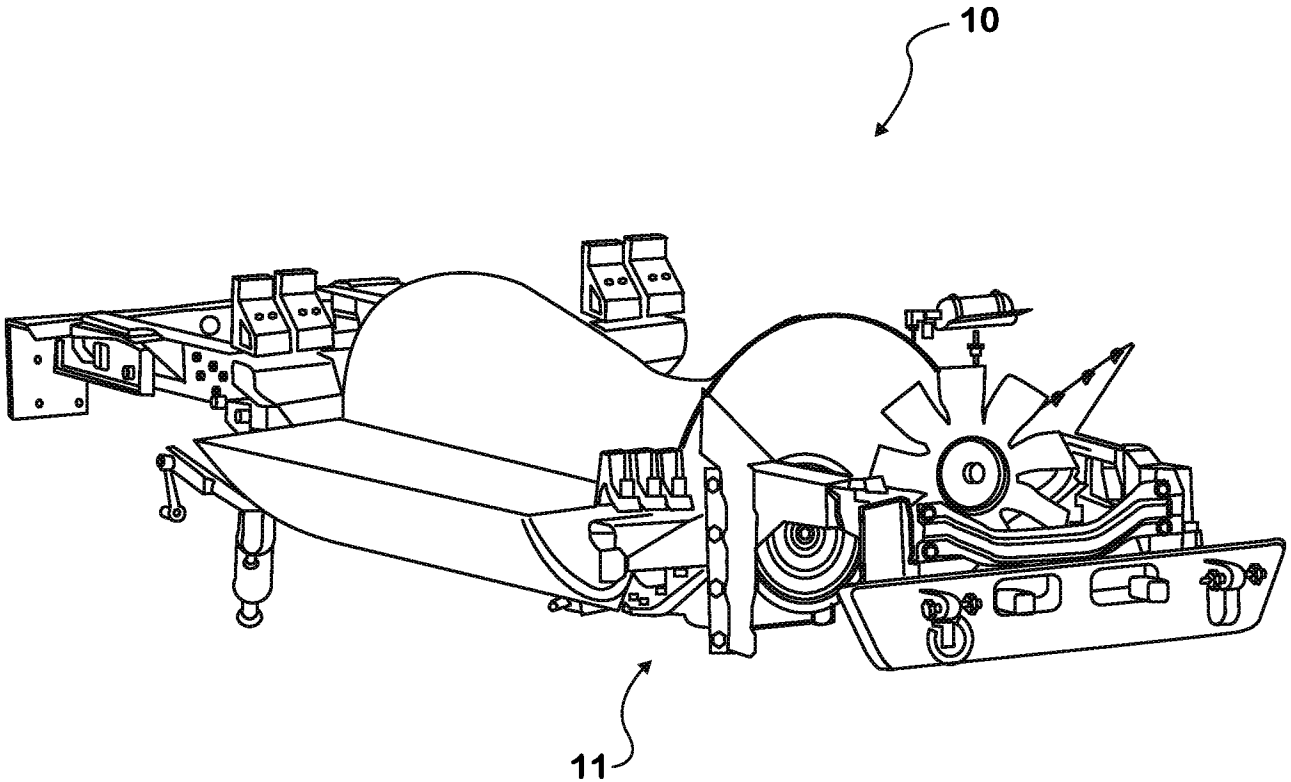
FIG. 7 is a perspective view of a portion of a vehicle having yet another embodiment of the armored underbelly device.
Figure 10:
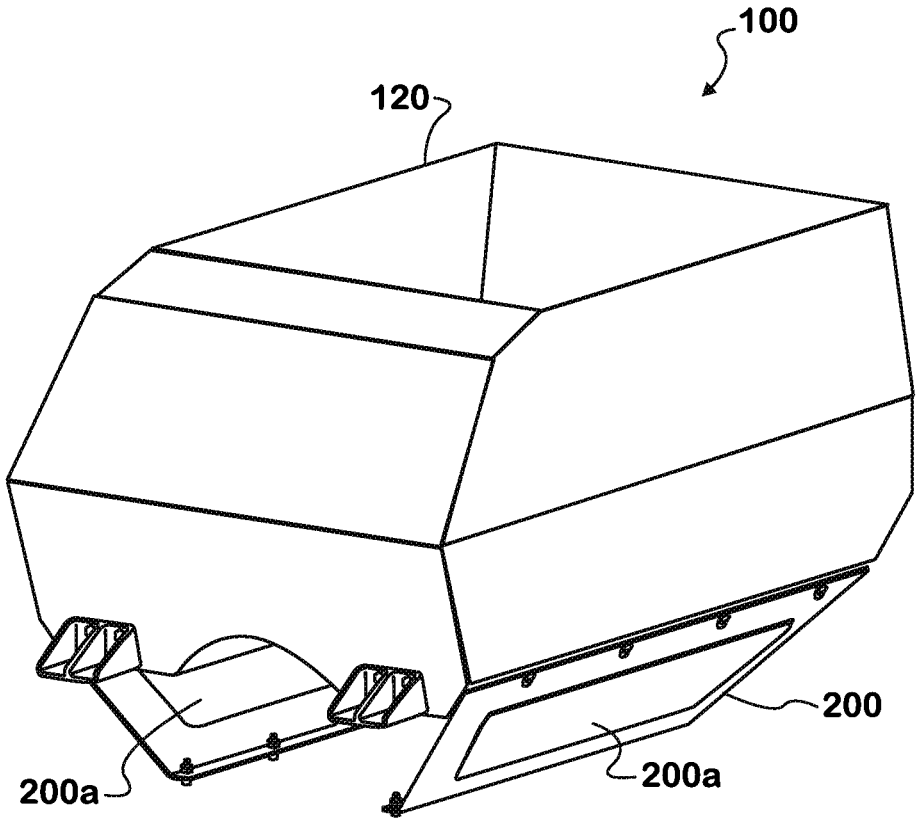
FIG. 10 is a perspective view of a portion of a personnel cabin for a vehicle having an embodiment of the armored underbelly device and including a shield structure.

Referring to FIGS. 1-8, there are illustrated several embodiments of an armored underbelly composite device, or blast floor, is generally designated by the numeral 10, as well as the components thereof. The device 10 is designed for use as an underbelly or floor of a personnel cabin 12 of a vehicle (not shown), particularly a military vehicle, which is used in war-zones for transporting personnel or cargo. However, other military vehicles may also be retro-fitted with embodiments of the present device 10 to protect both military personnel as well as components of the propulsion system (e.g., drive axles, engine, etc.) when the vehicle encounters an explosive device. Specifically, the underbelly device is integral with a chassis 11, forming the underside of the cabin 12 (FIGS. 5-7). In this manner, the underbelly device 10 functions to diminish or halt certain classes of ballistic and blast threats at a weight that is at least 50% less than a comparable monolithic solution, while providing a structural and automotive function as part of the occupant cabin and/or chassis configuration of the vehicle.

Figure 1:
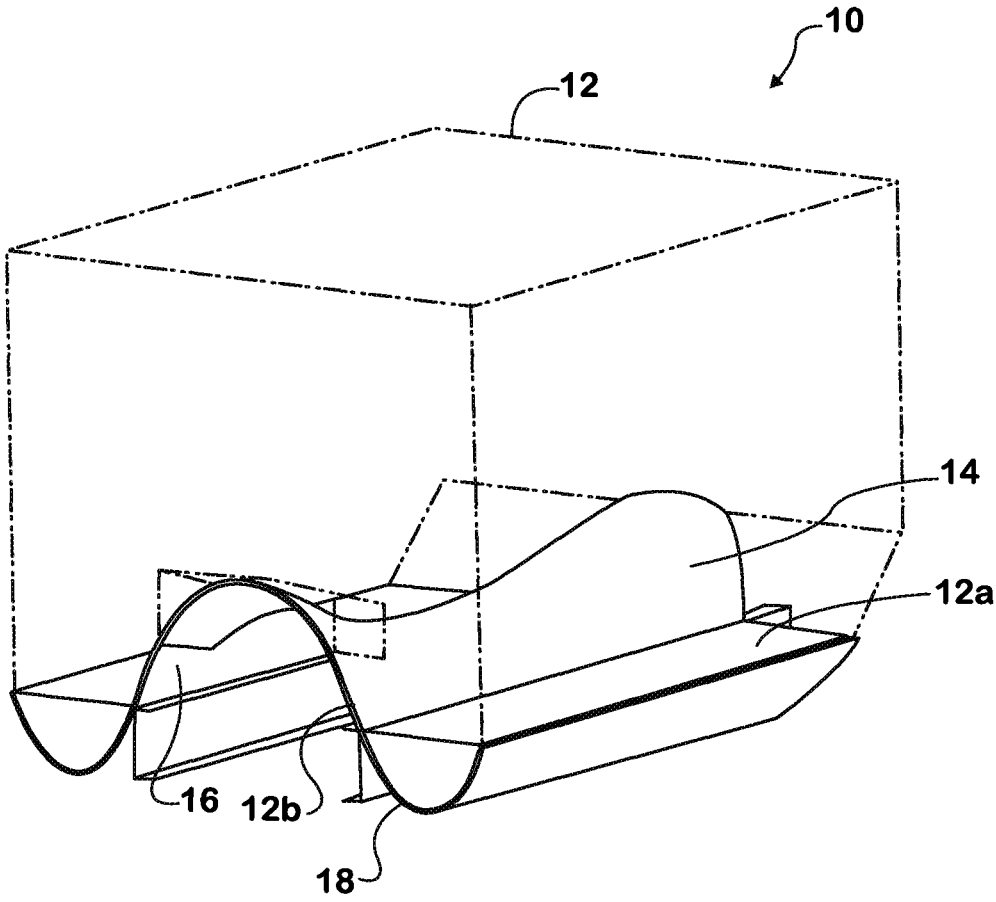
FIG. 1 is an embodiment of the armored underbelly device shown within a personnel cabin of a vehicle.

Generally speaking, the device 10 of FIG. 1 comprises a layered composite structure. The layered construction itself is composed of a sandwich, whose outer layers 14, 16 are generally metal and bonded or adhered to an inner layer or layers 18 composed of a "fragmentation catching" material. In addition, the inner layer 18 creates a distance or space between the outer metal layers 14, 16 resulting in a second modulus or modulus of rigidity, which is better able to resist bending resulting from blast pressure when compared to traditional blast hulls. This section modulus is achieved at a reduced mass through use of the present composite structure when compared to monolithic metal panels with the same section modulus. The first outer layer 14 acts as a "floor" to the interior of the cabin 12. The second outer layer or lower metal layer 16 of the composite structure has increased rigidity and acts as an initial barrier to blast fragmentation. The second outer layer 16 slows approaching fragmentation, i.e., reducing kinetic energy, and breaks up fragments into smaller pieces creating fragment dispersion and reducing individual fragment mass. The inner layer 18 acts primarily as the mechanism for "fragmentation catching," but also provides a secondary function as the "separation filler," between the outer layers, thereby increasing the section modulus, as described above, and enhancing the overall structural rigidity.

Turning to FIGS. 1, 8 and 9, in detail the composite structure includes a first layer 14, a second layer 16, and a middle core layer 18, sandwiched between the first and second layers (FIG. 8). The composite structure may be constructed from a single piece (FIG. 9). The first layer 14 forms an interior bottom surface 12*a* of the cabin 12. The first layer 14 may be constructed from a high-strength metal, either as a single layer or multiple layers, including at least one material selected from the group consisting of a high-strength low-alloy steel, a hardened aluminum, or a high carbon steel. The thickness of the first layer 14 can range from about 0.125 inches to about 0.5 inches.

The second layer 16 forms an exterior bottom surface 12*b* of the cabin 12. The second layer 16 may be constructed from a high-strength metal material, either as a single layer or multiple layers, including from at least one material selected from the group consisting of a high-strength low-alloy steel, a hardened aluminum, or a high carbon steel. The thickness of the second layer 16 can range from about 0.125 inches to about 0.5 inches.

The middle or core layer 18 is sandwiched between the first 14 and second 16 layers, and is constructed primarily from a polymer material, as either a single layer or multiple layers. Alternatively, the middle or core layer 18 is constructed from a plurality of layers comprised of at least one material selected from the group consisting of a thermoplastic polymer, a fiber reinforced composite or an aromatic polyamide. The thickness of the middle or core layer 14 can range from about 0.5 inches to about 1.0 inches.

Figure 11:
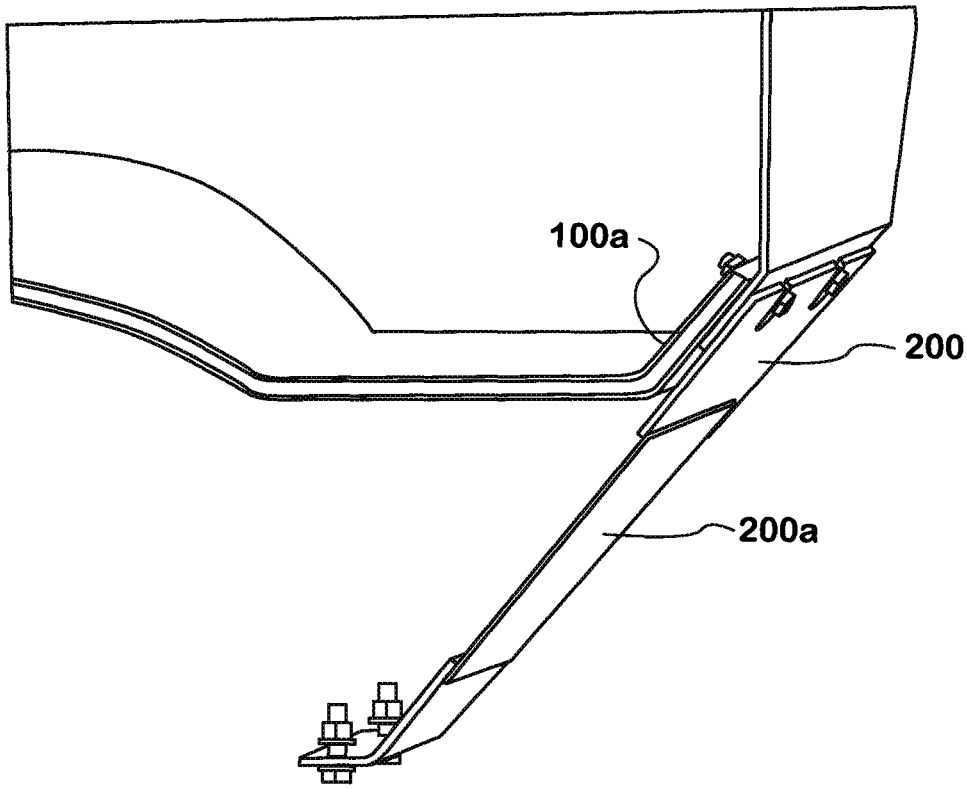
FIG. 11 is a cut-away side view of the embodiment in FIG. 10.
Figure 12:
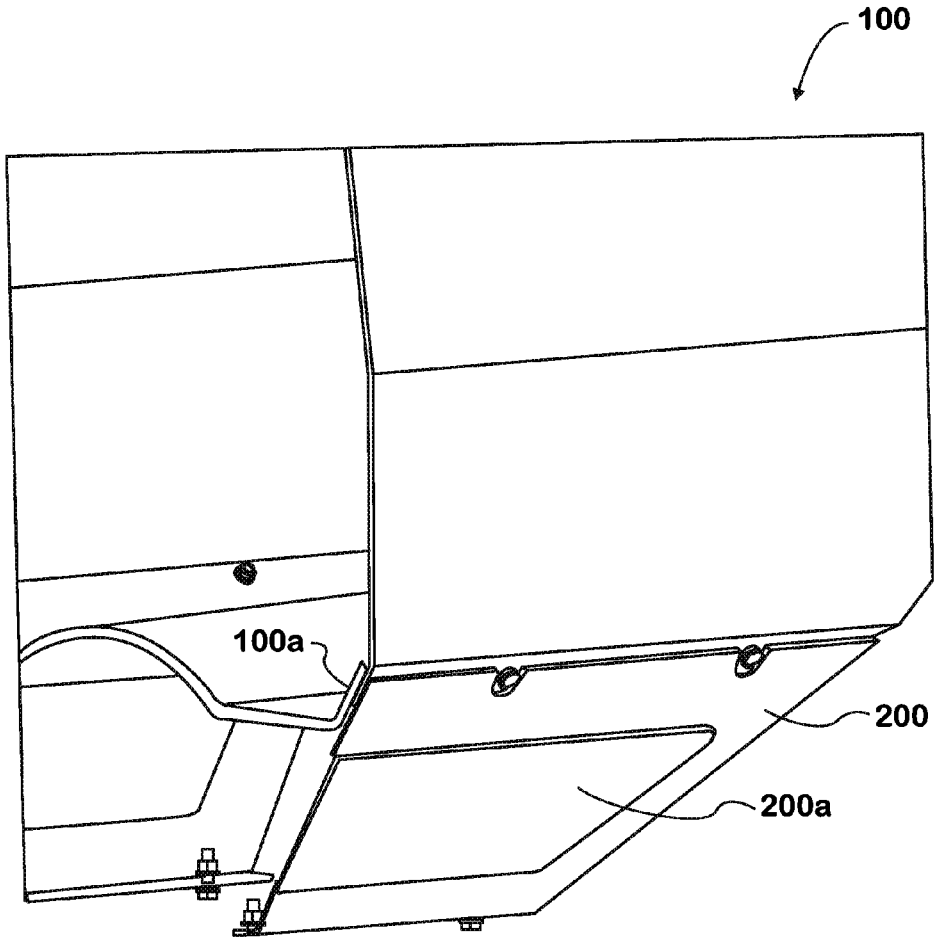
FIG. 12 is another side view of the embodiment of FIG. 10 showing the shield structure.

Referring to FIGS. 10-13, there is shown another embodiment of the present armored underbelly device 100, including at least a pair of shields or shield structures 200, which are incorporated into the device. As shown in FIGS. 10-13, the shield structures 200 are external to and positioned below the cabin 120. The shield structures 20 may also be referred to a blast wings or blast shields. The shields 200 function to divert any blast force underneath the vehicle. In addition, the shields 200 may include a vent 200*a* for the blast force to pass through from any centerline detonations below the vehicle. As shown in FIG. 11, the shields are generally attached to the underbelly device 100 at lateral opposing edges 100*a*, 100*b* (see FIG. 8A) and may also be attached to the chassis (not shown) through known fastening means, such as screws and bolts. In this manner, should the shield 200 encounter a blast strong enough to remove it from the underbelly device 100, it is less likely the cabin 120 itself will be damaged. In addition, the shield structures 200 may assist in directing the blast force (V) out from either end of the underbelly device 100 and cabin 120, as shown by the arrows in FIG. 13.

Figure 16:
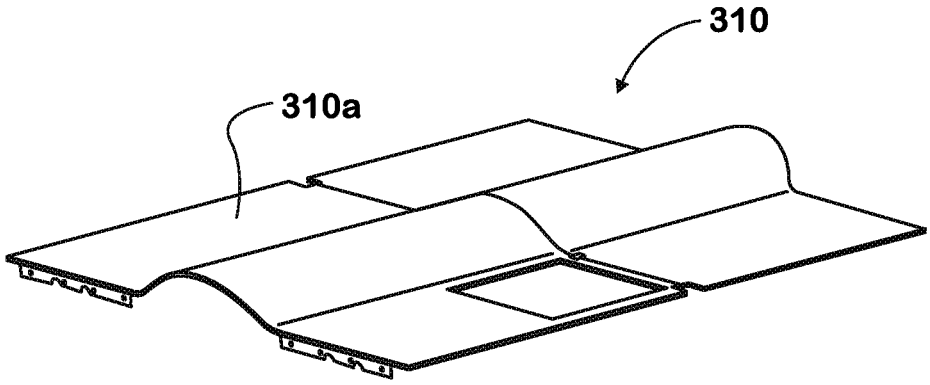
FIG. 16 is a top perspective view of the second structure or interior floor of the armored underbelly device.
Figure 17:
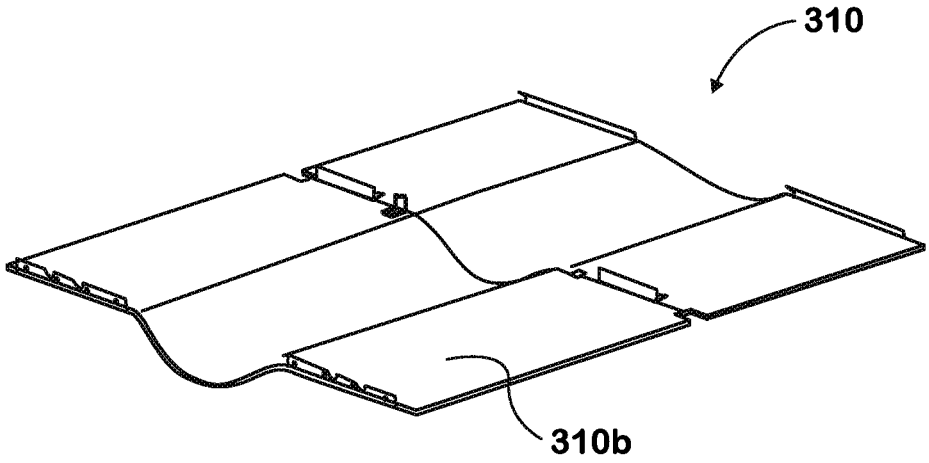
FIG. 17 is a bottom perspective view of the second structure or interior floor of the armored underbelly device.

FIGS. 14-18 illustrate the underbelly device 300 and a complimentary second multi-layered structure 310, together forming an armored underbelly system, which is positioned above and partially integrated with the underbelly device 300, forming an interior floor of the cabin 320. FIG. 14A illustrates a close-up view of system, which may also include a shield or shield structure 330, as described above. As shown in FIGS. 16 and 17, the second multi-layered structure 310 may be constructed from at least two surfaces, a top surface 310*a* and a bottom surface 310*b*. The top surface 310*a* may be constructed from a single layer or multiple layers of at least one material selected from the group consisting of a thermoplastic polymer, a fiber reinforced composite or an aromatic polyamide. The bottom surface 310*b*, is likewise constructed from a single layer or multiple layers of at least one material selected from the group consisting of a high-strength low-alloy steel, a hardened aluminum, or a high carbon steel. The structure 310 acts as a "false floor" within the interior of the cabin 320, and perhaps more importantly, is a fragmentation barrier or spall liner directly to the interior of the cabin and its occupants.

Figure 18:
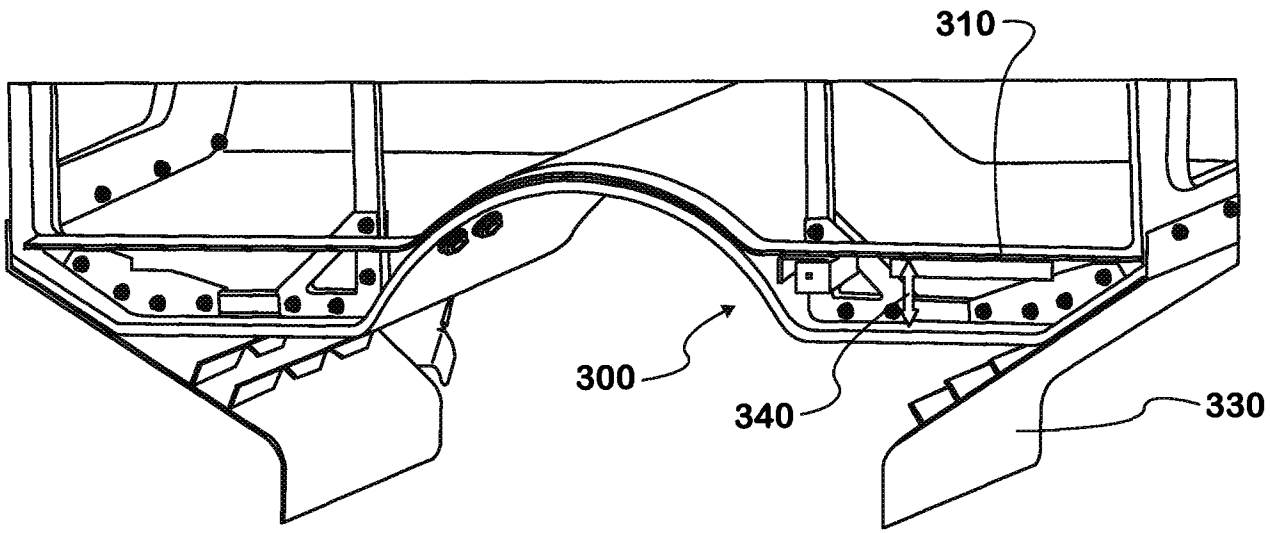
FIG. 18 a cut-away view of the bottom section of a personnel cabin showing an embodiment of the armored underbelly system, including the underbelly device and the second structure or interior floor of the device.

FIG. 18 illustrates the installation of the second structure or interior floor 310, in relation to the underbelly device 300. The interior floor 310 is spaced above the underbelly structure 300, following the same configuration as the underbelly structure, while leaving an air gap 340 between the interior floor and the underbelly. The air gap 340 provides yet another measure of protection to the occupants of the cabin 320, as it further deflects the fragments from entering the cabin. The air gap can range from between about 2.0 inches and about 4.0 inches depending on the specific requirements of the vehicle in which the underbelly device and interior floor system are being installed.

As illustrated in the accompanying Figures showing the various embodiments, the underbelly device (for simplicity will be referred to generally as 10) in all instances is configured generally having a heightened section including a plurality of high areas, above a central longitudinal plane area, and a plurality of low areas, below the lateral plane of the interior area of the cabin 12, 120 or 320. FIGS. 1-7 illustrate alternative embodiments and configurations of the device 10, showing specifically curvilinear, saddle and sinusoidal shapes. While a specific shape or embodiment will be illustrated, it should be understood that other configurations, such as those created by sharper, rectangular, or square lines, and peaks and valleys, may also be used in creating the configuration of the present device 10. The plurality of high and low areas create deflection faces and venting openings, which deflect and vent the blast and resulting fragmentation away from the interior of the cabin, as well as, separation distances for separating the interior of the cabin from the blast force. The high and low areas of the underbelly device further act to dissipate the force of the explosion. As previously noted, the second multilayer structure or interior floor 310 likewise follows the same configuration as the underbelly device.

Figure 2:
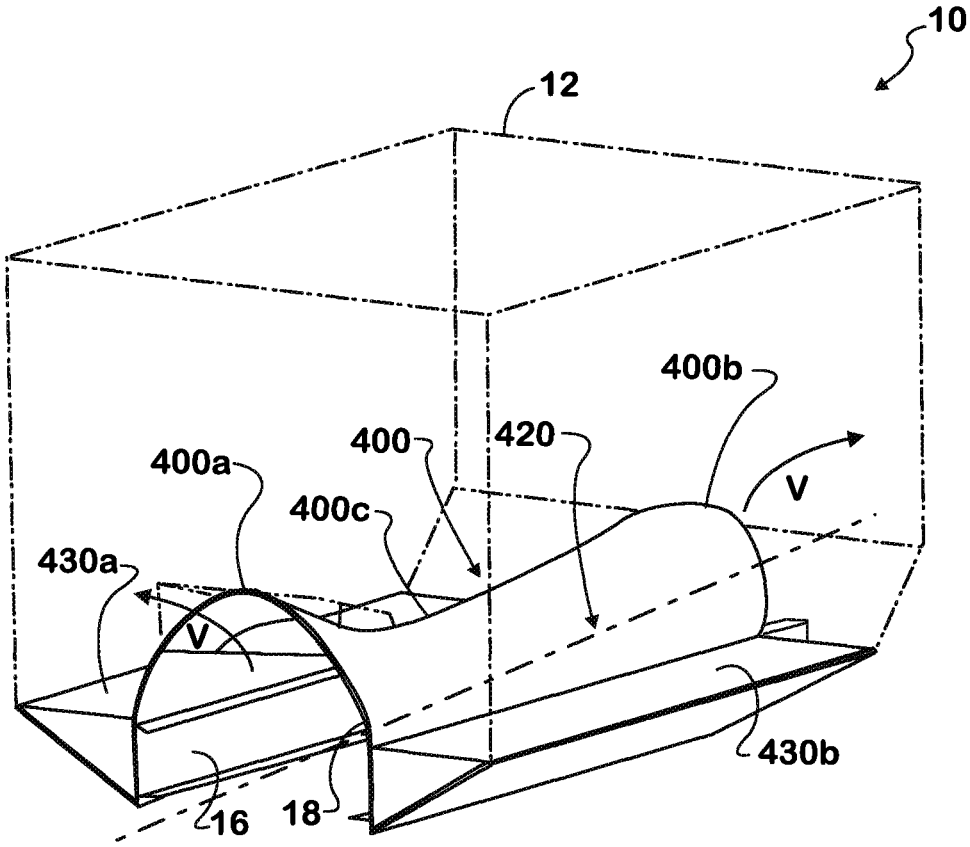
FIG. 2 is another embodiment of the armored underbelly device shown within the cabin of a vehicle.
Figure 3:
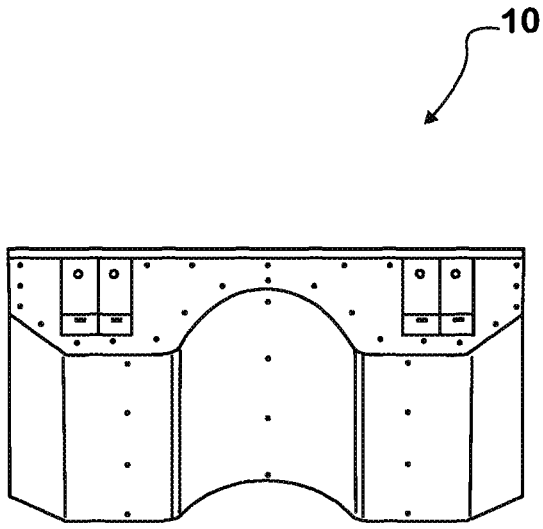
FIG. 3 is a perspective view of a configuration of the armored underbelly device.
Figure 4:
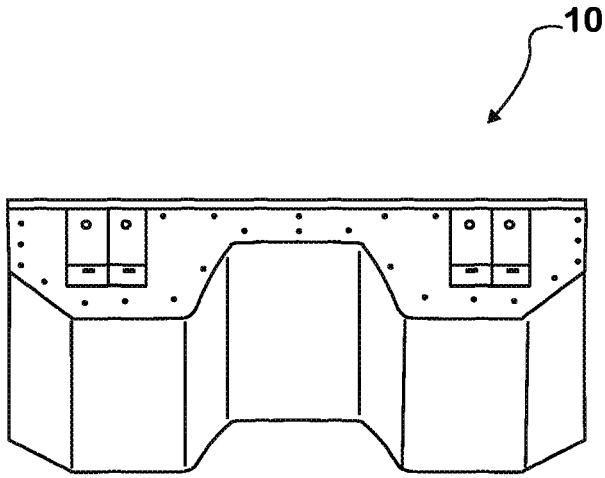
FIG. 4 is a perspective view of another configuration of the armored underbelly device.
Figure 13:
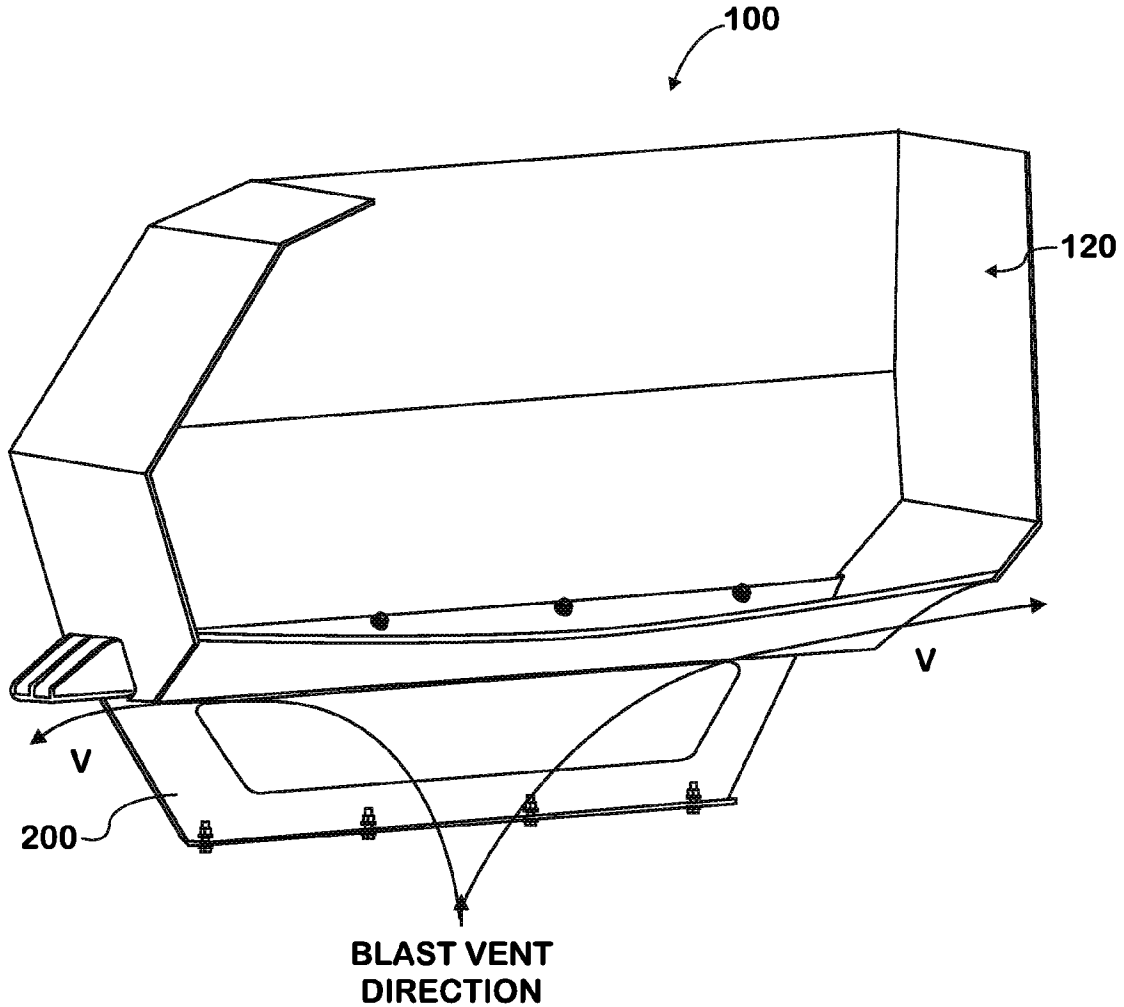
FIG. 13 is a cut-away view of the cabin and the armored underbelly device installed therein.
Figures 14, 14A:
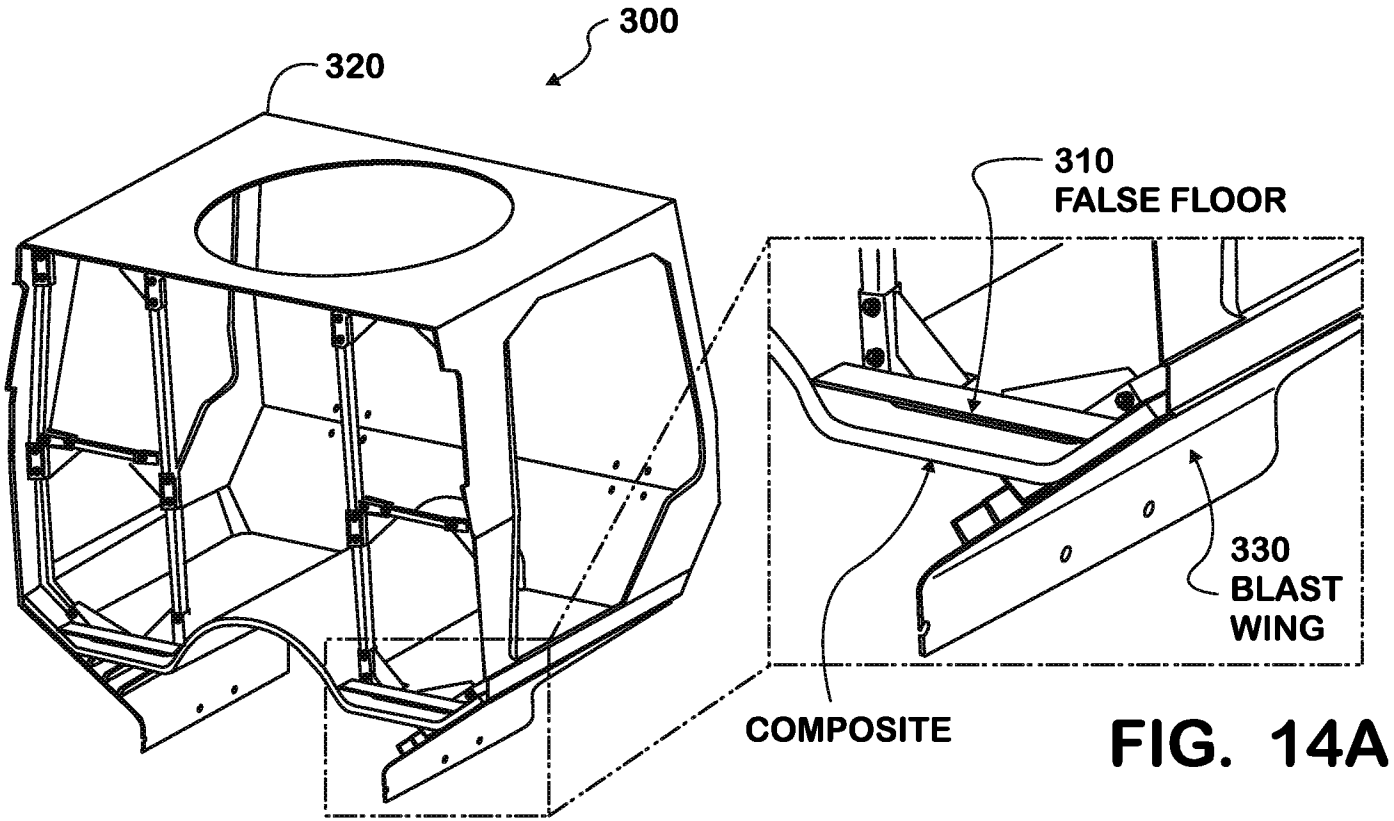
FIG. 14 is a cut-away view of a personnel cabin with an embodiment of the armored underbelly device installed therein, wherein a second structure or interior floor is shown.
FIG. 14A is a close-up view of the device and shield structure.
Figure 15:
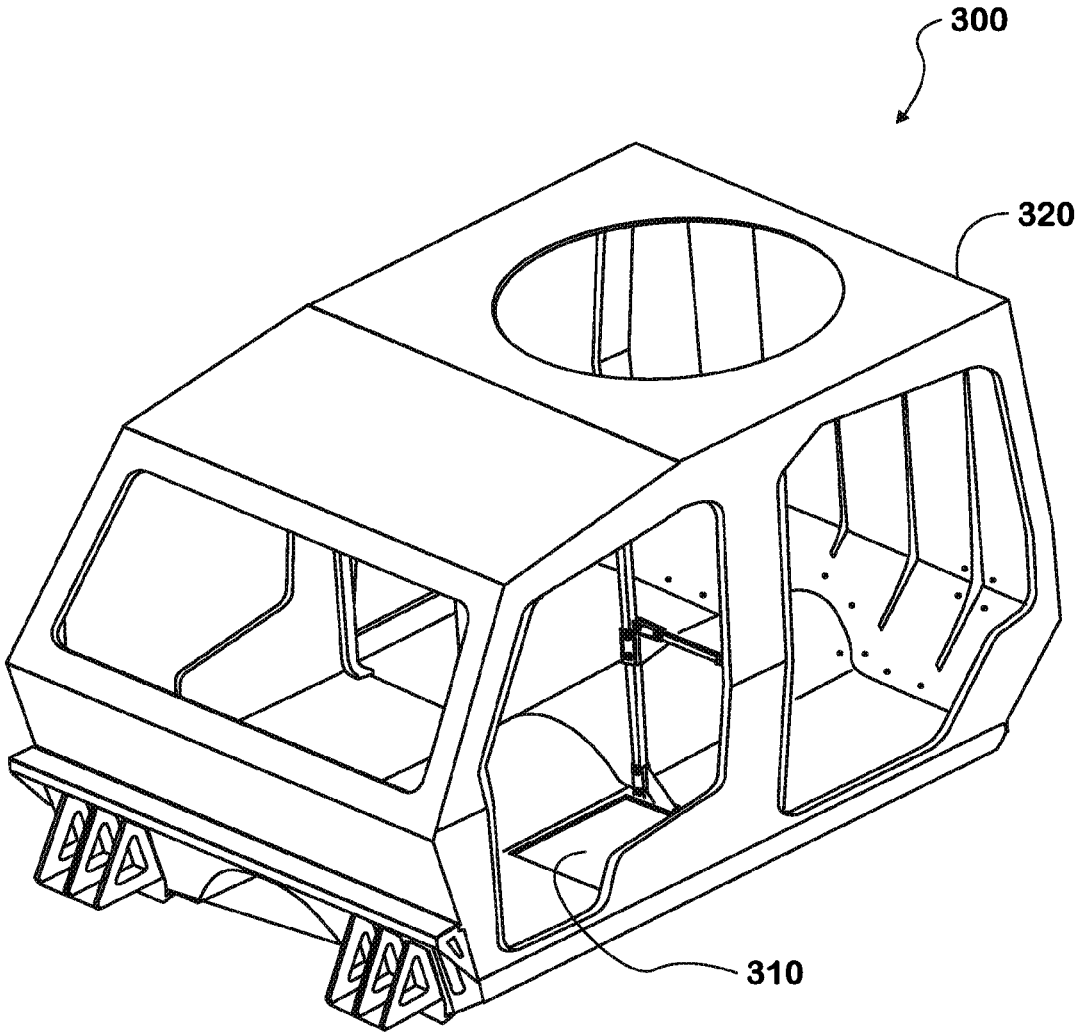
FIG. 15 is a cut-away view of a cabin with an embodiment of the armored underbelly device installed therein, wherein the interior floor is shown.

FIG. 2 will be used to illustrate one embodiment of the configuration of the underbelly device 10. In this particular embodiment, the underbelly device 10 includes a raised ridge 400 along a central longitudinal line area 420 (illustrated by a dotted line) of the cabin 12, and lower parallel sides or edges 430*a*, 430*b*, along either side of the raised ridge 400. The raised ridge 400 further includes opposing higher ends 400*a*, 400*b*, and a lower center 400*c* along the central longitudinal area 420 of the cabin 12. It is these higher ends or areas 400*a*, 400*b* and lower center 400*c*, which create the deflection faces, venting areas and separation distances discussed above. The higher ends or areas 400*a*, 400*b* in particular, direct the blast force (V) outwardly from either end of the cabin 12 (as shown by the arrows) away from the occupant interior, rather than up through the middle, or central longitudinal line area 420 of the cabin. FIG. 13 shows a cut-away view also illustrating the deflection and venting areas.

The underbelly device 10 is designed to meet or exceed military requirements for hull breach and occupant performance criteria when subjected to a given type of blast threat. In addition, the underbelly device meets the requirements for minimal floor (subfloor) deformation and tactical load requirements, while being manufactured at a competitive cost.

What is claimed is:

1. A vehicle armor for use as an underbelly of a personnel cabin for a vehicle, the vehicle armor comprising:

a first layer forming an interior bottom surface of the cabin and comprised of a high-strength metal material;

a second layer forming an exterior bottom surface of the cabin and comprised of a high-strength metal material;

a middle layer sandwiched between the first and second layers and comprised of a polymer material; and a second multi-layered structure comprising a first layer comprised of a glass fiber reinforced polymer matrix material and a second layer comprised of a metal, wherein the second multi-layered structure is positioned above and partially integrated with the underbelly forming an interior floor of the cabin, wherein the second multi-layered structure is configured having a raised ridge along a central longitudinal line area of the cabin and lower parallel sides complementary to the underbelly.

2. The vehicle armor of claim 1, wherein the first layer is comprised of at least one material selected from the group consisting of a high-strength low-alloy steel, a hardened aluminum, or a high carbon steel.

3. The vehicle armor of claim 1, wherein the second layer is comprised of at least one material selected from the group consisting of a high-strength, low-alloy steel, a hardened aluminum, or a high carbon steel.

4. The vehicle armor of claim 1, wherein the middle layer is comprised of at least one material selected from the group consisting of a polypropylene thermoplastic composite or a glass fiber reinforced thermoplastic composite.

5. The composite armor of claim 1, wherein the middle layer comprises a plurality of layers comprised of at least one material selected from the group consisting of a polypropylene thermoplastic composite, a fiber reinforced composite or aromatic polyamide.

6. The vehicle armor of claim 1, wherein the underbelly is configured having a raised ridge along a central longitudinal line area of the cabin and lower parallel sides.

7. The vehicle armor of claim 6, wherein the raised ridge includes opposing higher ends and a lower center along the central longitudinal area of the cabin.

8. The vehicle armor of claim 7, wherein the raised ridge creates a distance at opposing ends of the cabin between the interior space of the cabin and an exterior threat.

9. The vehicle armor of claim 6, wherein the underbelly has a curvilinear configuration.

10. The vehicle armor of claim 6, wherein the underbelly has a saddle configuration.

11. The vehicle armor of claim 1, wherein the interior floor is spaced above the underbelly on either parallel side of the central longitudinal line area to form an air gap there between.

12. The vehicle armor of claim 1, wherein the underbelly is integral to a chassis of the vehicle.

13. The vehicle armor of claim 1, further comprising at least one exterior shield structure attached to an outer edge of the underbelly.

14. The vehicle armor of claim 13, wherein the shield structure extends angled downward from the underbelly.

15. An armored floor system for attachment to a vehicle having a chassis and a cabin, the system comprising:

a first multi-layered structure having a first layer, a second layer and a core layer between the first and second layers, wherein the structure is integral with the chassis forming an underbelly of the cabin; and, a second multi-layered structure positioned above and partially integrated with the first structure, wherein the first and second structures have a configuration extending longitudinally within a central interior space of the cabin, wherein the first and second structures are configured having a heightened section along a central longitudinal area of the cabin and lower parallel sides.

16. The armored floor system of claim 15, wherein the core layer comprises a plurality of layers comprised of at least one material selected from the group consisting of a thermoplastic polymer, a fiber reinforced composite or aromatic polyamide.

17. The armored floor system of claim 15, wherein the second multi-layered structure forms an interior floor within the interior space of the cabin.

18. The armored floor system of claim 15, wherein the second structure is integral to the first structure along the heighted section.

19. The armored floor system of claim 15, wherein the second structure is spaced above the first structure on either parallel side of the central longitudinal area to form an air gap there between.

20. A blast protection floor for an occupant cabin of a personnel vehicle, the floor comprising a composite structure configured having a plurality of high areas and low areas creating deflection faces and separation distances between an interior of the cabin and an exterior threat; and a second composite structure positioned above and having a configuration parallel to the floor, wherein the second composite structure creates a fragmentation penetration barrier within the interior of the cabin.

21. The blast protection floor of claim 20, wherein the high areas are above a central longitudinal plane area of the interior of the cabin, while the low areas are below the central longitudinal plane area of the cabin.

22. The blast protection floor of claim 21, wherein the high areas include a raised ridge along the central longitudinal plane area of the cabin, the raised ridge creating the separation distance between the interior of the cabin and the exterior threat.

23. The blast protection floor of claim 22, wherein the raised ridge further includes opposing high ends and a lower center along the central longitudinal plane area creating the deflection faces for the exterior threat.

24. The blast protection floor of claim 23, wherein the opposing higher ends vent a blast force away from the interior space of the cabin.

* * * * *